US010157716B2

(12) United States Patent
To

(10) Patent No.: US 10,157,716 B2
(45) Date of Patent: Dec. 18, 2018

(54) CIRCUIT BREAKING SAFETY LOCK AND DUAL-POWER SWITCH

(71) Applicant: ManFuk To, Hong Kong (CN)

(72) Inventor: ManFuk To, Hong Kong (CN)

(73) Assignee: Nijing Zhang, Guangdong (CN)

( * ) Notice: Subject to any disclaimer, the term of this patent is extended or adjusted under 35 U.S.C. 154(b) by 62 days.

(21) Appl. No.: 15/404,337

(22) Filed: Jan. 12, 2017

(65) Prior Publication Data

US 2018/0182571 A1 Jun. 28, 2018

(30) Foreign Application Priority Data

Dec. 26, 2016 (CN) ..... 2016 1 1219486

(51) Int. Cl.
*H01H 15/10* (2006.01)
*H01H 9/20* (2006.01)

(52) U.S. Cl.
CPC ..... *H01H 9/20* (2013.01); *H01H 15/10* (2013.01); *H01H 2235/01* (2013.01)

(58) Field of Classification Search
CPC ..... H01H 9/20; H01H 15/10; H01H 2235/01; H01H 3/3015; H01H 3/3021
USPC ..... 200/50.01, 400
See application file for complete search history.

(56) References Cited

U.S. PATENT DOCUMENTS 5,981,888 A * 11/1999 Robarge ..... H01H 3/3031 200/400
6,380,830 B1 * 4/2002 Dahl ..... H01H 3/26 200/400
6,403,902 B1 * 6/2002 Castonguay ..... H01H 71/04 200/308
9,859,068 B2 * 1/2018 Oneufer ..... H01H 3/04
2014/0353133 A1 * 12/2014 Roehrig ..... H01H 9/24 200/318

FOREIGN PATENT DOCUMENTS

JP 2001229797 A * 8/2001 ..... H01H 39/00

* cited by examiner

*Primary Examiner* — Edwin A. Leon
(74) *Attorney, Agent, or Firm* — Christopher & Weisberg, P.A.

(57) ABSTRACT

The circuit breaking safety lock includes a slider, a first locking piece, a first locking shaft, a first pressure spring and a first lifting mechanism, wherein the first locking piece is fixedly connected with the slider, the first locking shaft is locked with the first locking piece, the first pressure spring is used for moving the first locking shaft along a direction towards the slider, and the first lifting mechanism is used for moving the first locking shaft along a direction away from the slider. The double-power switch includes a housing, a first position electrode, a second position electrode, a movable electrode, a bi-position lock and the circuit breaking safety lock, wherein the movable electrode is fixedly connected with the slider and moves between the first position electrode and the second position electrode with the slider.

14 Claims, 17 Drawing Sheets

CIRCUIT BREAKING SAFETY LOCK AND DUAL-POWER SWITCH

CROSS-REFERENCE TO RELATED APPLICATIONS

This application is a Submission under 35 U.S.C. § 371 for U.S. National Stage Patent Application of, and claims priority to, Chinese Application Number 201611219486.3, filed Dec. 26, 2016, entitled "CIRCUIT BREAKING SAFETY LOCK AND DUAL-POWER SWITCH", the entire contents of which is hereby incorporated herein by reference.

FIELD OF THE INVENTION

The present invention relates to power supply circuit devices, in particular to a circuit breaking safety lock and a dual-power switch.

BACKGROUND OF THE INVENTION

With rapid increases of city electricity consumption, higher demands on the reliability of electricity consumption are imposed, especially in important occasions such as elevators, fire control, hospitals, subways, communication where power supply should not be cut off, the reliability of a persistent power supply is of particular importance. For the important occasions above, a dual power switch is generally adopted to ensure a persistent and uninterruptable power supply. The dual power switch is mainly used for switching between power sources of master devices. Typically, a main loop of a load side is generally connected with a main power source side. When power outage occurs due to failure of the main power source side, the dual power switch may automatically connect the main loop of the load side with a backup power source side, so as to achieve the purpose of allowing the load side to supply power uninterruptedly.

However, existing dual power switches generally adopt direct switching of the first/second position electrodes, that is, there are only two states. If the circuit needs maintenance or a circuit device needs to be installed, it is difficult to ensure that the circuit keeps a completely cut-off state. Moreover, conventional double-power linear-motion switches use the elastic force of an energy-storage spring to return a movable electrode to an intermediate open position, as shown in FIG. 1. After the movable electrode 71 is released from a position at which it comes into contact with fixed electrodes 75, the movable electrode 71 makes a reciprocating movement under the effect of a right energy-storage spring 73 and a left energy-storage spring 72. The movable electrode 71 has to make multiple reciprocating movements before stopping at the intermediate open position by its own inertia, which takes a long time, and the open-circuit reliability is low.

SUMMARY OF THE INVENTION

An object of the invention is to provide a safety lock which has a shortened circuit breaking time and is able to ensure a completely circuit breaking.

Another object of the invention is to provide a dual power switch which provides a quick circuit-breaking function.

The technical solution adopted by the invention to solve its above technical problem is described as follows.

The invention discloses a circuit breaking safety lock, comprising: a slider; a first locking piece, fixedly connected with the slider; a first locking shaft, arranged peripherally of the slider, and configured to be displaceable up and down linearly relative to the slider, and to be locked with the first locking piece in a snap-fit manner; a first pressure spring, abutting on a side of the first locking shaft facing away from the first locking piece, for moving the first locking shaft along a direction towards the slider; and a first lifting mechanism, arranged peripherally of the slider, for moving the first locking shaft along a direction away from the slider.

As a further improvement to the above technical solution, the first lifting mechanism comprises a first electromagnet, a first shaft core and a first shaft core spring sleeved on the first shaft core, wherein the first shaft core has a first beveled lifting surface at a portion thereof in contact with the first locking shaft, and the first locking shaft has a first force-bearing portion matched with the first beveled lifting surface.

As a further improvement to the above technical solution, the first locking piece is provided with a first notch in a middle portion thereof for receiving an end of the first locking shaft, and has two lateral sides served as first sliding surfaces for guiding.

As a further improvement to the above technical solution, the first sliding surfaces are circular arc surfaces or beveled surfaces.

As a further improvement to the above technical solution, the first locking shaft, at one end thereof in contact with the first locking piece, is provided with a first locking shaft head which is provided with a rounded contact corner.

As a further improvement to the above technical solution, the circuit breaking safety lock further comprises a manual control lever, wherein the manual control lever is provided with a helically beveled surface at one end thereof in contact with the first locking shaft, and the first locking shaft is provided with a lateral groove matched with the helically beveled surface.

The invention further discloses a dual-power switch, comprising a housing, a first position electrode, a second position electrode, a movable electrode, a bi-position lock and the circuit breaking safety lock according to any one of claims 1 to 6, wherein the movable electrode is fixedly connected with the slider and moves between the first position electrode and the second position electrode with the slider.

As a further improvement to the above technical solution, the dual-power switch further comprises a first position electromagnet and a first position shaft core at a side of the first position electrode, and a second position electromagnet and a second position shaft core at a side of the second position electrode, wherein the first position shaft core and the second position shaft core are both fixedly connected with the slider.

As a further improvement to the above technical solution, the dual-power switch further comprises a first position energy-storage spring fixedly connected with the housing and arranged at the side of the first position electrode, and a second position energy-storage spring fixedly connected with the housing and arranged at the side of the second position electrode.

As a further improvement to the above technical solution, the bi-position lock comprises a second locking piece, fixedly connected with the slider; a second locking shaft, arranged peripherally of the slider, and configured to be displaceable up and down linearly relative to the slider, and to be locked with two sides of the second locking piece in a snap-fit manner; a second pressure spring, abutting on a side of the second locking shaft facing away from the second locking piece, for moving the second locking shaft along a direction towards the slider; and a second lifting mechanism, arranged peripherally of the slider, for moving the second locking shaft along a direction away from the slider.

As a further improvement to the above technical solution, the second lifting mechanism comprises a second electromagnet, a second shaft core and a second shaft core spring sleeved on the second shaft core, wherein the second shaft core has a second beveled lifting surface at a portion thereof in contact with the second locking shaft, and the second locking shaft has a second force-bearing portion matched with the second beveled lifting surface.

As a further improvement to the above technical solution, the second locking piece in a middle portion thereof has a second notch for guiding the second locking shaft in sliding, and the second notch is provided with second sliding surfaces at two inner lateral sides thereof.

As a further improvement to the above technical solution, the second sliding surfaces are circular arc surfaces or beveled surfaces.

As a further improvement to the above technical solution, the second locking shaft is provided with a second locking shaft head at one end thereof in contact with the second locking piece, and the second locking shaft head is provided with a rounded contact corner.

The present invention has the following beneficial effects:

The circuit breaking safety lock of the invention is capable of locking the slider fixedly connected to the movable electrode in the open position, ensuring that the dual-power switch is kept in a completely open state.

The dual-power switch of the invention is able to flexibly and quickly switch among the first position, the second position, and the intermediate open position, with reliable contacts and stable operation.

BRIEF DESCRIPTION OF THE DRAWINGS

FIG. 9(*b*) is a schematic diagram of the dual power switch of the invention in an intermediate open-circuit state.

FIG. 9(*c*) is a schematic diagram of the dual power switch of the invention in a state where the second position electrode is connected.

DETAILED DESCRIPTION

In order that the objects, features and effects of the present invention may be fully understood, a full and clear description of concepts, specific structures and technical effects produced of the present invention will be made below in connection with embodiments and accompanying drawings. Obviously, the embodiments described are merely a part, but not all embodiments of the present invention. Based on the embodiments of the present invention, other embodiments obtained by the skilled in the art without innovative faculty should all belong to the protective scope of the present invention. In addition, all the coupling/connecting relationships mentioned herein do not merely refer to direct connection or coupling of members, but rather a better coupling structure formed by adding or subtracting coupling accessories according to specific implementation. Technical features of the present invention may be mutually as long as they are not mutually contradictory.

Figure 2:
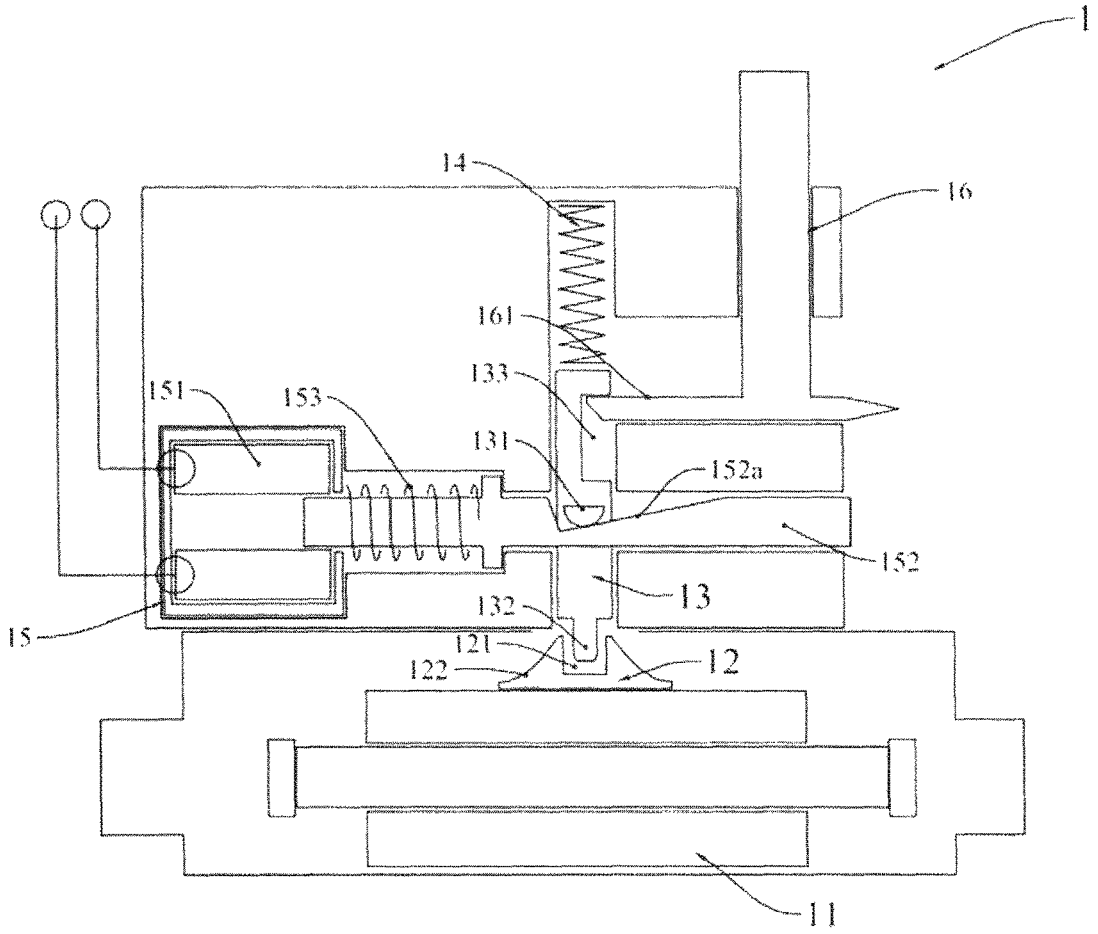
FIG. 2 is an overall structural diagram of a circuit breaking safety lock of the invention.

With reference to FIG. 2, a circuit breaking safety lock 1 of the invention comprises a slider 11, a first locking piece 12, a first locking shaft 13, a first pressure spring 14, a first lifting mechanism 15 and a manual control lever 16. The slider 11 drives a movable electrode to reciprocally move between contacts of two fixed electrodes.

The first locking piece 12 is fixedly connected with the slider 11, and provided in a middle portion thereof with a first notch 121 for receiving an end of the first locking shaft 13. The first locking piece 12 has two lateral sides served as first sliding surfaces 122 for guiding the first locking shaft 13 in sliding. When the first lifting mechanism 15 drives the first locking shaft 13 to move transversely, the first sliding surfaces 122 is capable of lifting up the first locking shaft 13 and causing the latter to move up and down. In this embodiment, the first sliding surfaces 122 are preferably circular arc surfaces or beveled surfaces.

The first locking shaft 13 is arranged peripherally of the slider 11 and is displaceable up and down linearly relative to the slider 11. The first locking shaft 13 is locked with the first locking piece in a snap-fit manner, and is provided with a first locking shaft head 132 at one end thereof in contact with the first locking piece 12, and the first locking shaft head 132 is provided with a rounded contact corner.

The first pressure spring 14 abuts against one side of the first locking shaft 13 facing away the first locking piece 12, for moving the first locking shaft 13 along a direction towards the slider 11. During both the upward and downward movements of the first locking shaft 13, the first pressure spring 14 is in a compressed state, thus to ensure a sliding contact between the first locking shaft 13 and the first locking piece 12. When the first locking shaft 13 passes over an uppermost point of the first sliding surfaces 122 of the first locking piece 12, the first locking shaft head 132 is brought into the first notch 121 by the first pressure spring 14 and locked therein.

The first lifting mechanism 15 is arranged peripherally of the slider 11, for moving the first locking shaft 13 along a direction away from the slider 11. The first lifting mechanism 15 comprises a first electromagnet 151, a first shaft core 152 and a first shaft core spring 153 sleeved on the first shaft core 152. The first shaft core 152 is provided with a first beveled lifting surface 152*a* at a portion thereof in contact with the first locking shaft 13, and the first locking shaft 13 is provided with a first force-bearing portion 131 matched with the first beveled lifting surface 152*a*. In this preferred embodiment, the first force-bearing portion 131 refers to a groove arranged on a lateral side of the first locking shaft 13 and a semi-cylindrical projection provided within the groove.

For controlling the opening and closing of the circuit breaking safety lock 1, the manual control lever 16 is provided with a helically beveled surface 161 at one end thereof in contact with the first locking shaft 13, and the first locking shaft 13 is provided with a lateral groove 133 matched with the helically beveled surface 161. When the manual control lever 16 rotates, the lateral groove is pushed by the helically beveled surface 161 to move upwards, thus to drive the first locking shaft 13 to move away from the first locking piece 12.

Figure 3A:
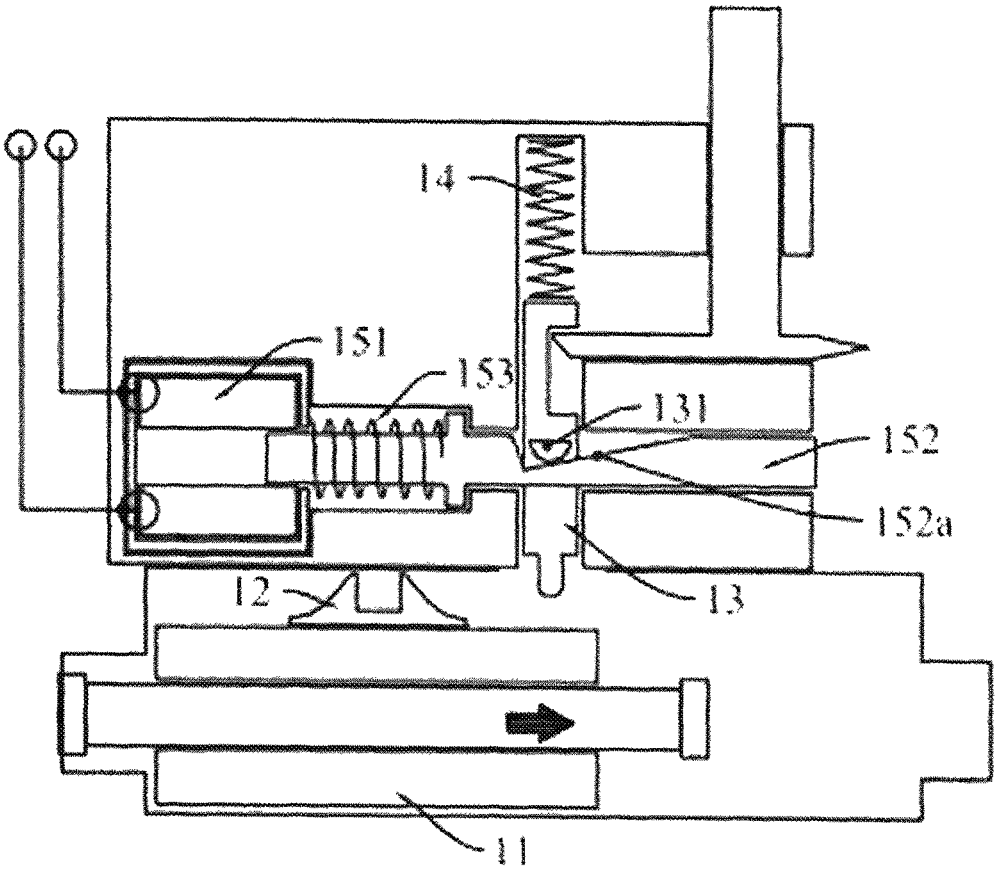
FIG. 3(*a*) to 3(*c*) are schematic diagrams showing a locking process of the circuit breaking safety lock of the invention.
Figure 3B:
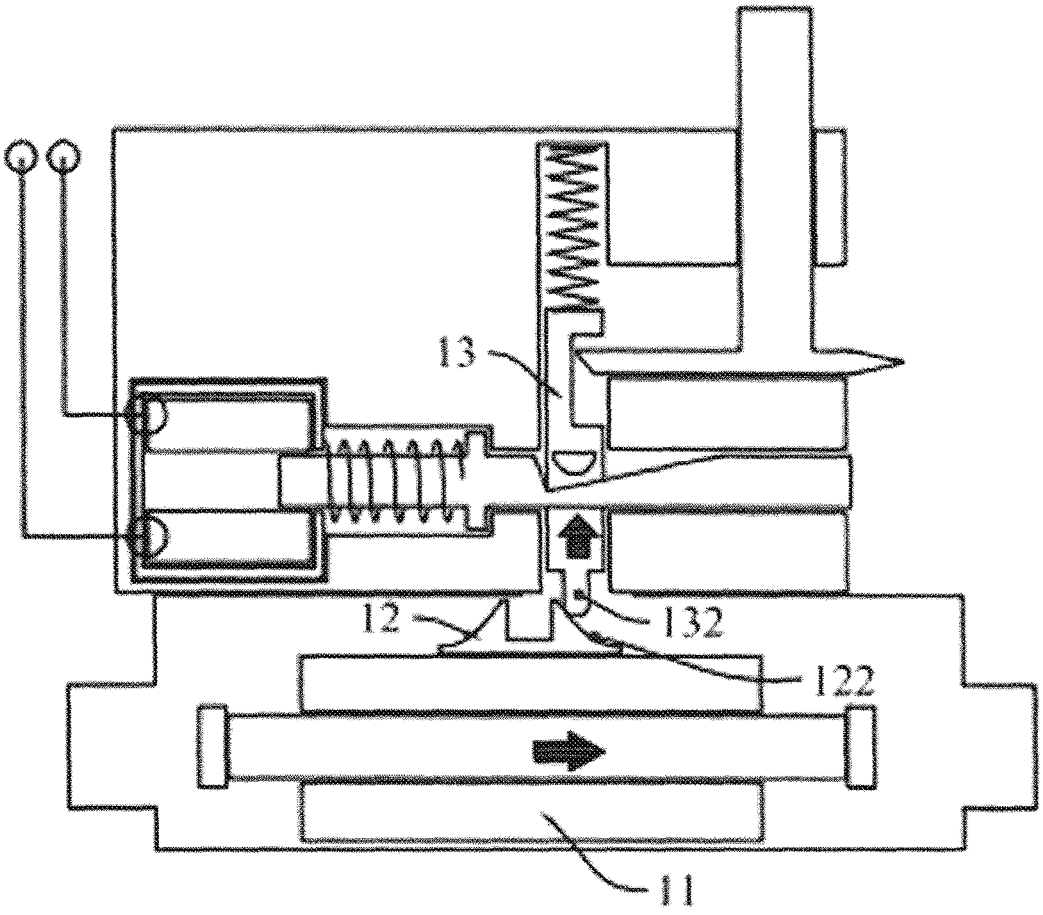
Figure 3C:
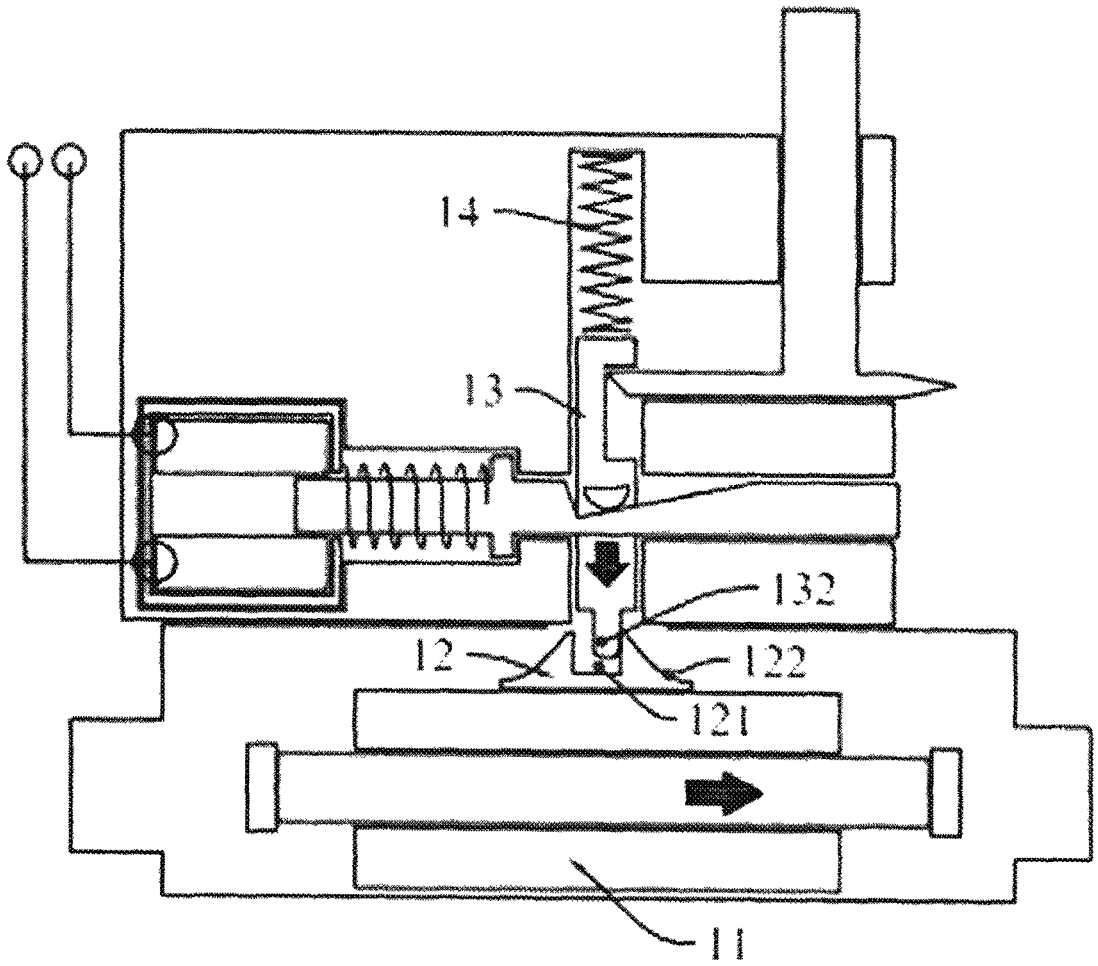

In FIG. 3(*a*) to 3(*c*) a locking process of the circuit breaking safety lock of the invention is shown.

As shown in FIG. 3(*a*), while the slider 11 drives the first locking piece 12 to slide rightwards, the first electromagnet 151 does not exert a leftward attractive force on the first shaft core 152, the first shaft core 152 is in an extended state under the effect of the first shaft core spring 153, the first pressure spring 14 applies a downward elastic force on the first locking shaft 13, and the first force-bearing portion 131 is located at or in the proximity of the lowermost position of the first beveled lifting surface 152*a*.

As shown in FIG. 3(*b*), the slider 11 continues to drive the first locking piece 12 to move rightwards, the first locking shaft head 132 comes into contact with the first sliding surfaces 122, and the first locking shaft 13 is pushed by the first sliding surfaces 122 to move upwards.

As shown in FIG. 3(*c*), the slider 11 drives the first locking piece 12 to move rightwards, and after passing over an apex of the first sliding surfaces 122, the first locking shaft head 132 falls into the first notch 121 under the effect of the elastic force of the first pressure spring 14, and thus the locking process of the first locking shaft 13 and the first locking piece 12 is completed, i.e. the slider is locked in an intermediate position.

Figure 4A:
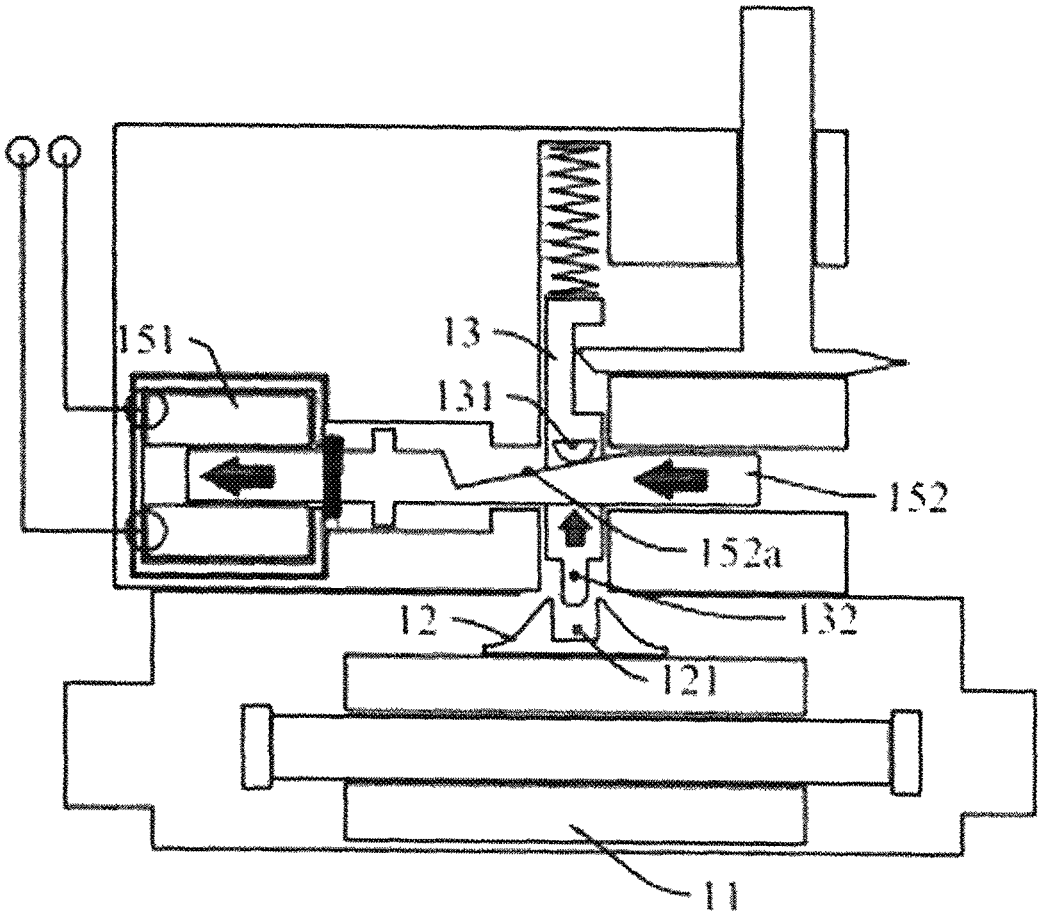
FIG. 4(*a*) to 4(*c*) are schematic diagrams showing an unlocking process of the circuit breaking safety lock of the invention.
Figure 4B:
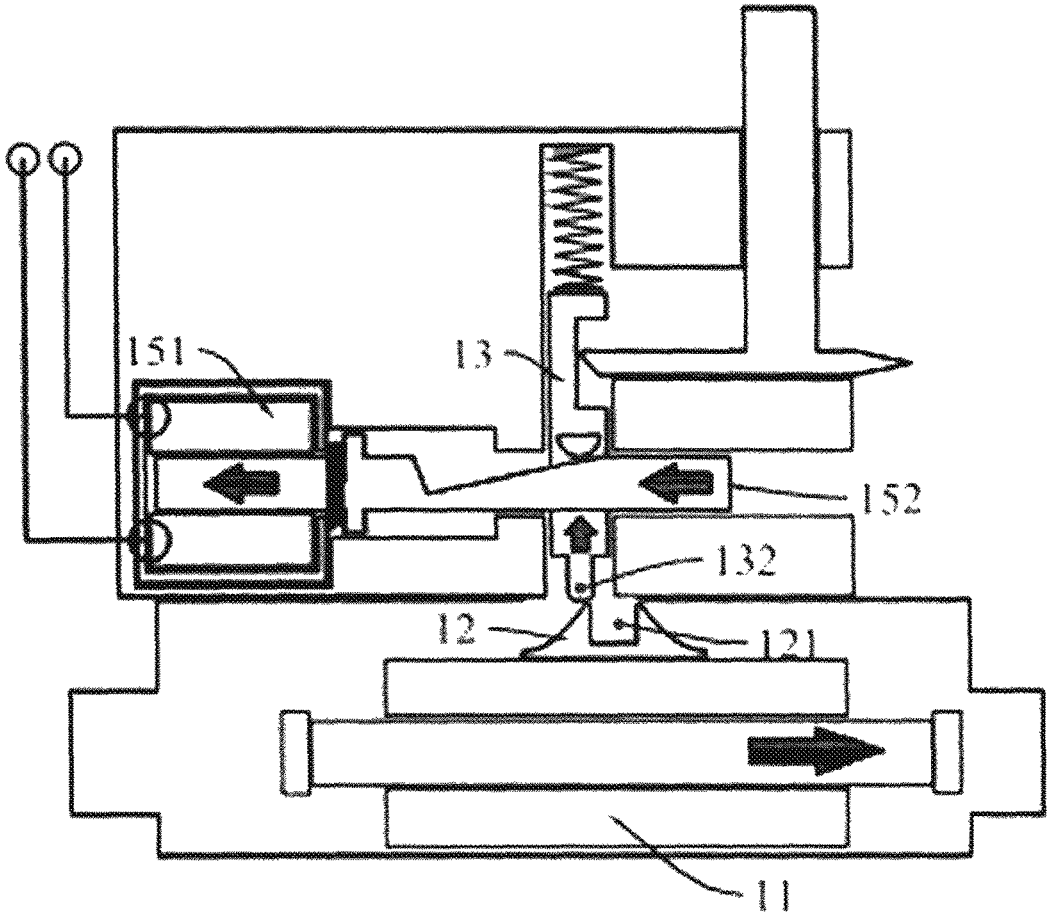
Figure 4C:
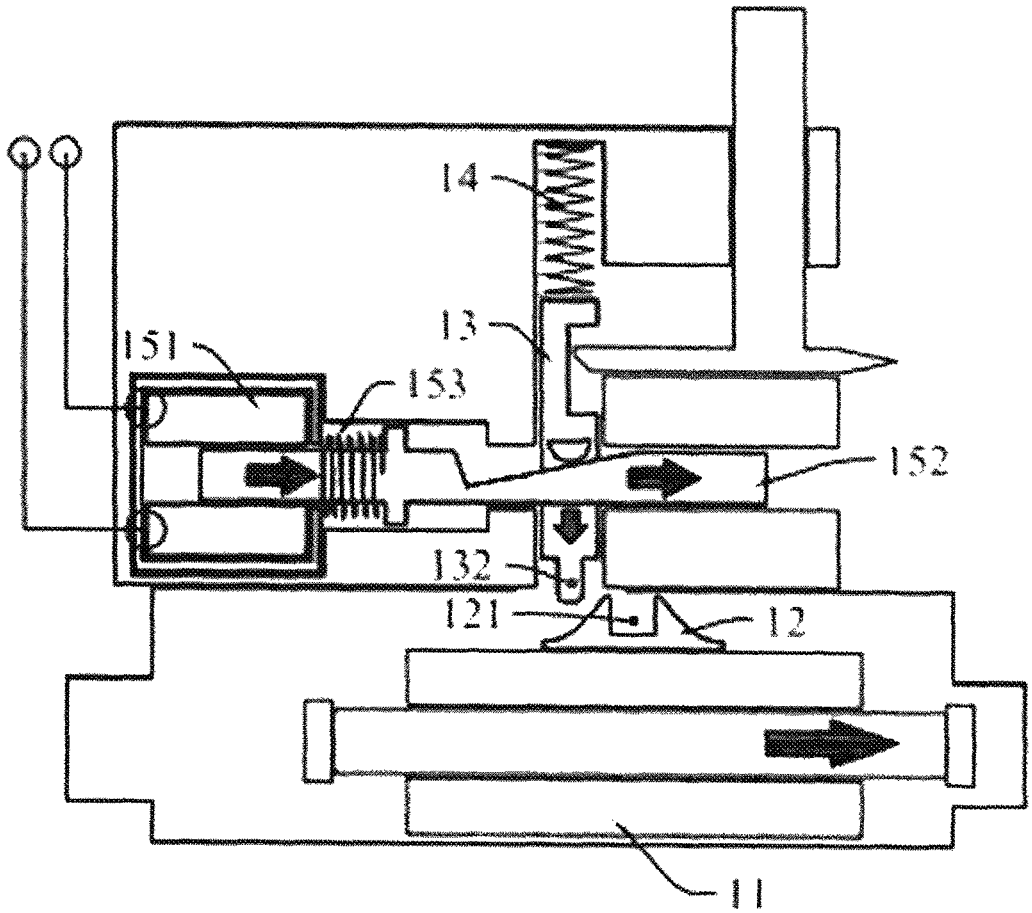

In FIG. 4(*a*) to 4(*c*) an unlocking process of the circuit breaking safety lock of the present invention is shown.

As shown in FIG. 4(*a*), both the slider 11 and the first locking piece 12 are locked in the intermediate position, the first shaft core 152 is picked up by the first electromagnet 151 and moved leftwards, the first force-bearing portion 131 is pushed by the first beveled lifting surface 152*a* to move upwards, such that the first locking shaft 13 is moved upwards, until the first locking shaft head 132 reaches a position higher than the first notch 121.

As shown in FIG. 4(*b*), the first electromagnet 151 keeps picking up the first shaft core 152, the first locking shaft remains raised, and the slider 11 and the first locking piece 12 move rightwards, thus the disengagement of the first locking shaft head from the first notch 121 is completed.

As shown in FIG. 4(*c*), the slider 11 and the first locking piece 12 continue to move rightwards. When the first locking shaft head 132 is disengaged from the first notch 121, the first shaft core 152 is released by the first electromagnet and moved rightwards by the elastic force of the first shaft core spring 153, while the first locking shaft 13 moves downwards under the effect of the elastic force of the first pressure spring 14, thus the unlocking process of the circuit breaking safety lock is completed.

Figure 5A:
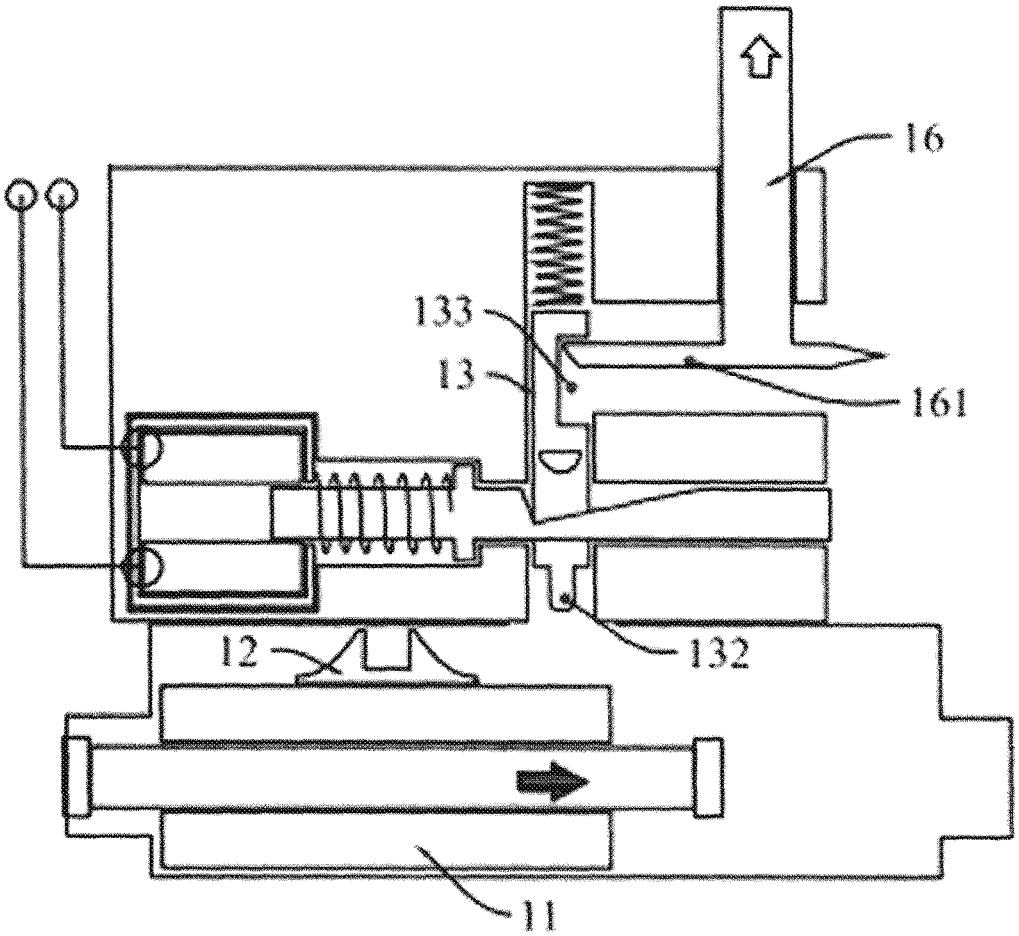
FIG. 5(*a*) to 5(*c*) are schematic diagrams showing an operation process of the circuit breaking safety lock of the invention in a manual close state.
Figure 5B:
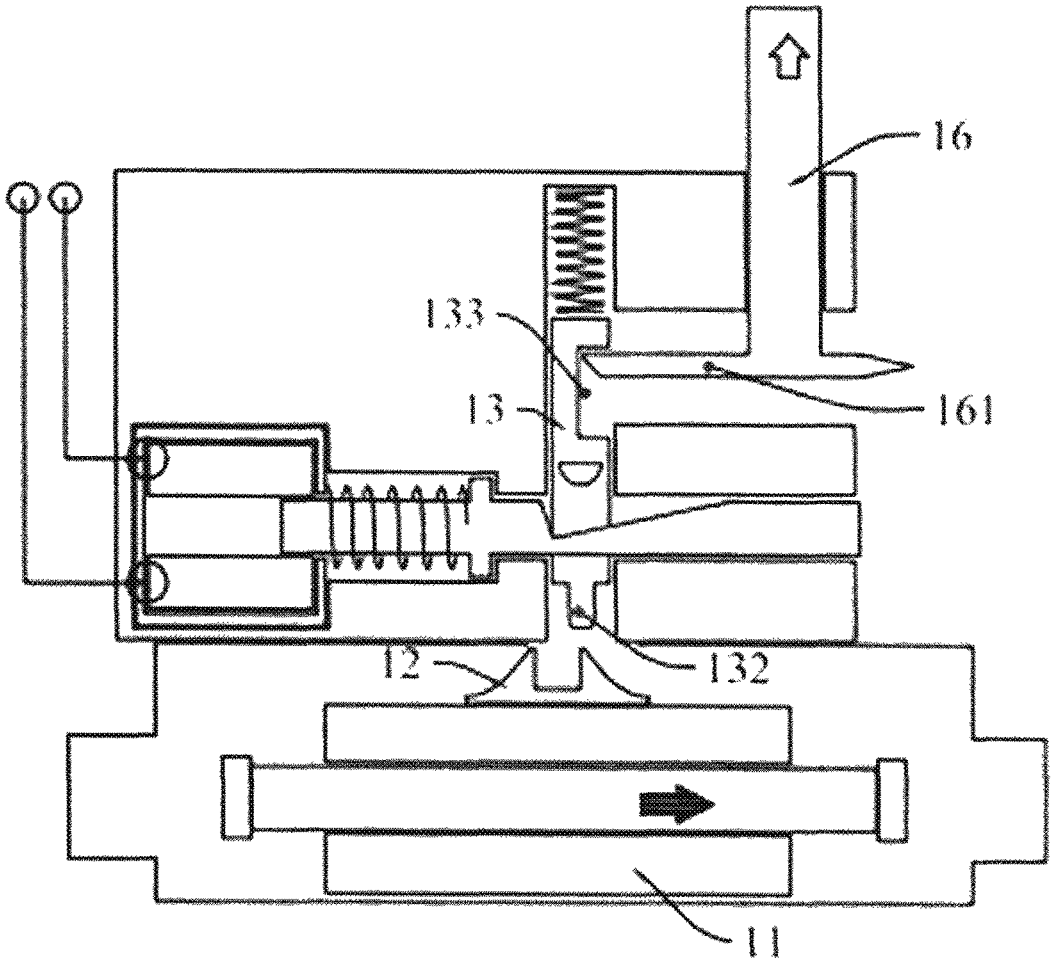
Figure 5C:
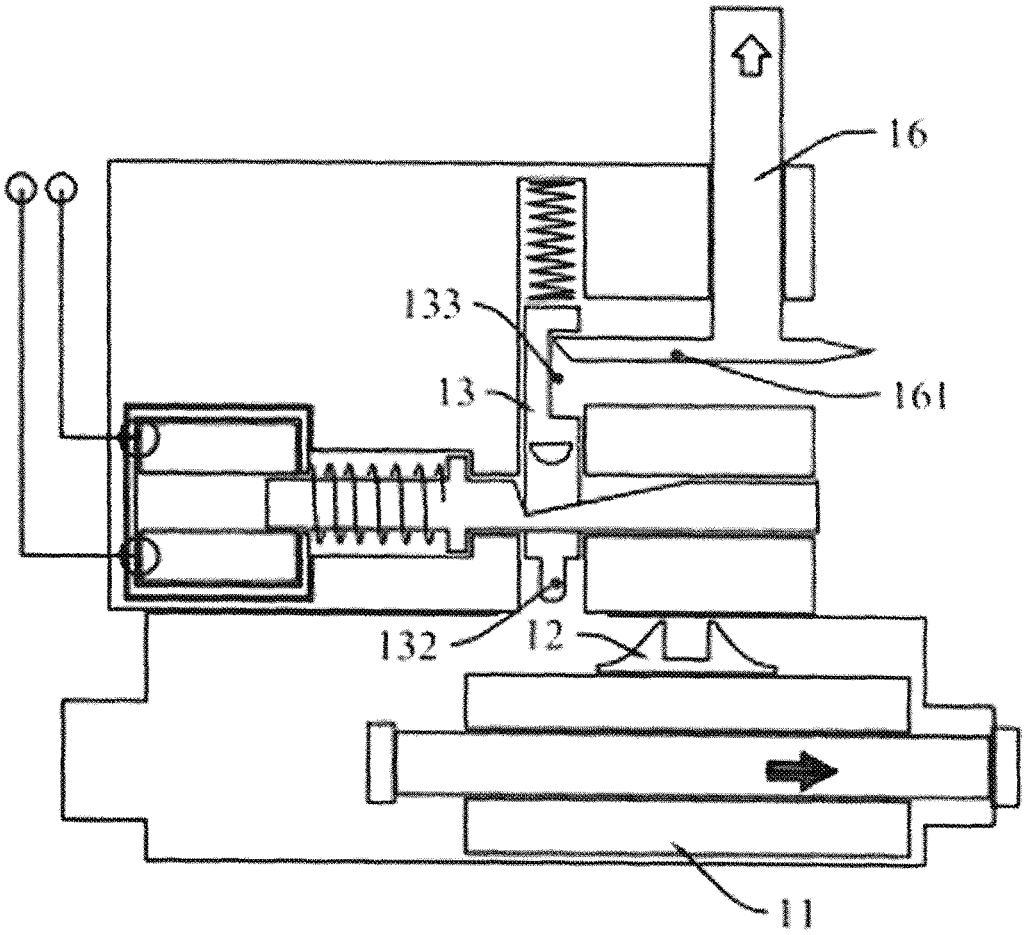

In FIG. 5(*a*) to 5(*c*) an operation process of the circuit breaking safety lock of the invention in a manual closed state is shown. As shown in FIG. 5(*a*) to 5(*c*), the manual control lever 16 applies an upward thrust through its helically beveled surface 161 to the lateral groove 133 of the first locking shaft 13, and the first locking shaft head 132 is held above the uppermost point of the first locking piece 12, thus when the slider 11 and the first locking piece 12 are reciprocally moved, the first locking piece 12 is kept from contacting the first locking shaft 13, and the circuit breaking safety lock is thus in the closed state.

Figure 1:
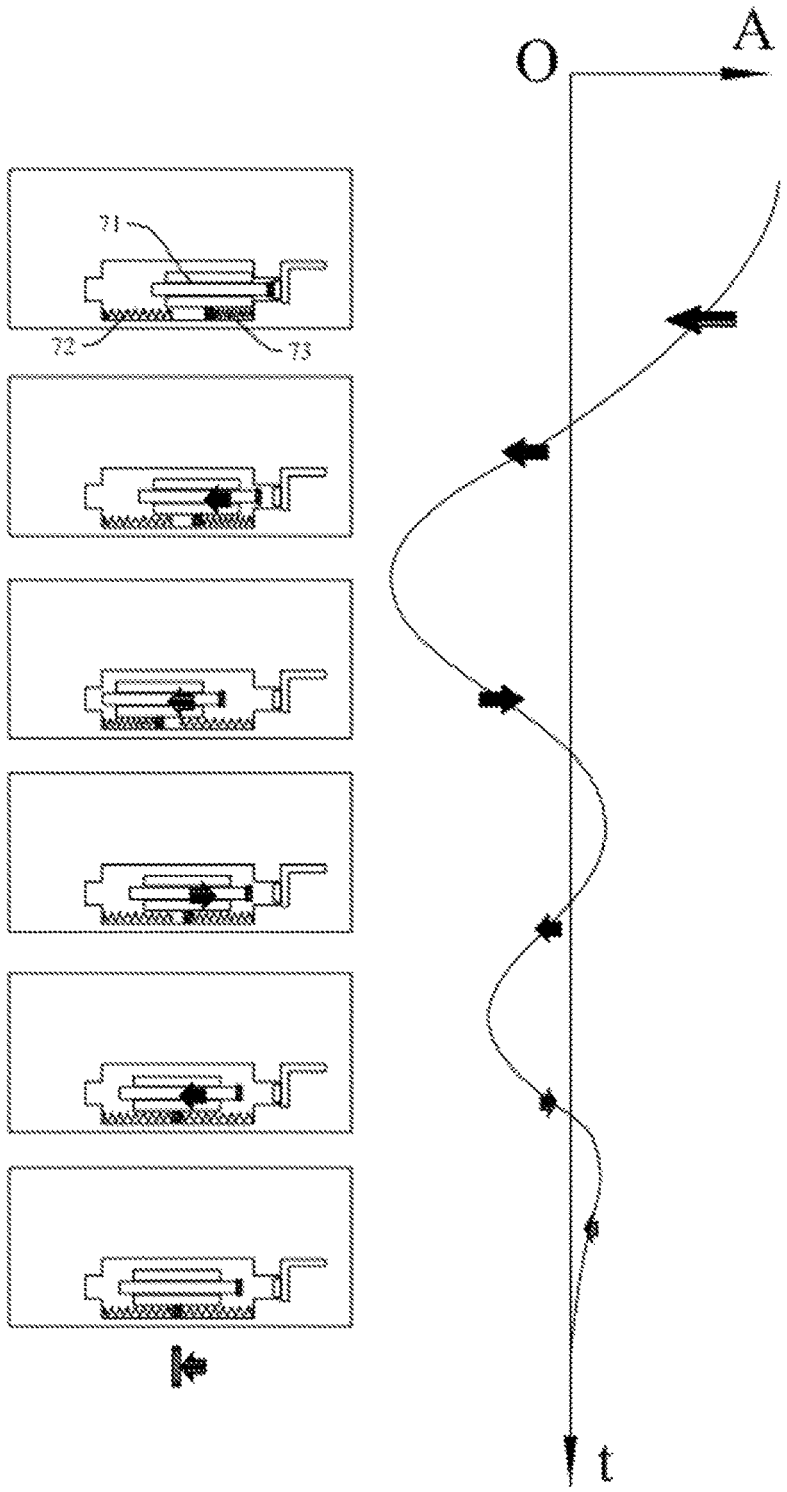
FIG.1 Prior Art
FIG. 1 is a diagram showing a process of a movable electrode of a double transfer switch of the prior art returning to an intermediate open position.
Figure 6:
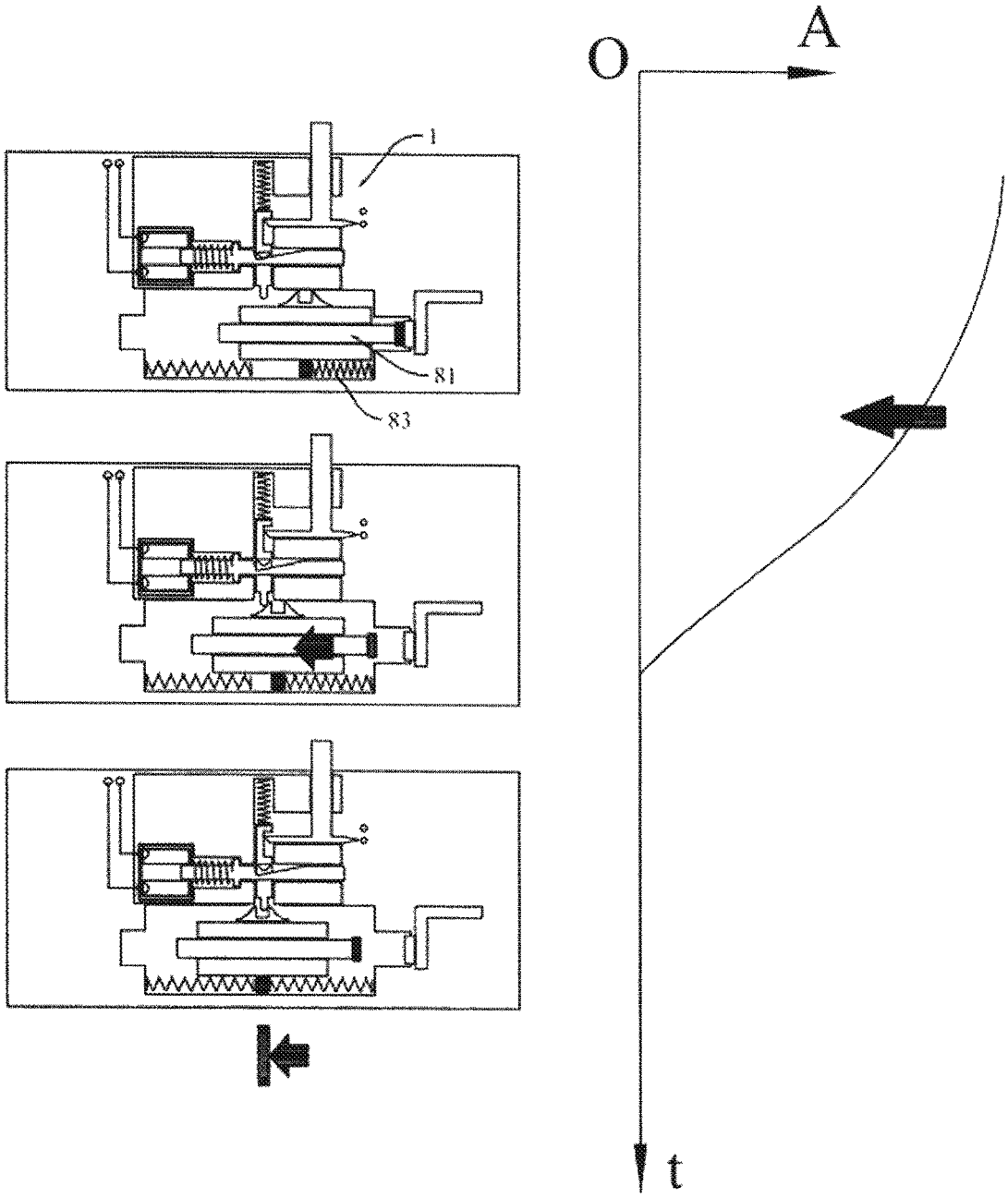
FIG. 6 is a diagram showing a process of the movable electrode returning to the intermediate open position under a combined action of an energy-storage spring and the circuit breaking safety lock.

FIG. 6 is a diagram showing a process of the movable electrode of the dual power switch returning to the intermediate open position under a combined action of an energy-storage spring and the circuit breaking safety lock. As shown in FIG. 6, the dual power switch comprises the circuit breaking safety lock 1. When a movable electrode 81 is moved leftward and passed through the intermediate open position by a right energy-storage spring 83, the movable electrode 81 will be locked immediately by the circuit breaking safety lock 1. As can be seen from the time comparison in FIG. 1, the circuit breaking safety lock 1 is capable of greatly shortening the opening time, and avoids reciprocating oscillations of the movable electrode 81 before the latter returns to the open position.

Figure 7:
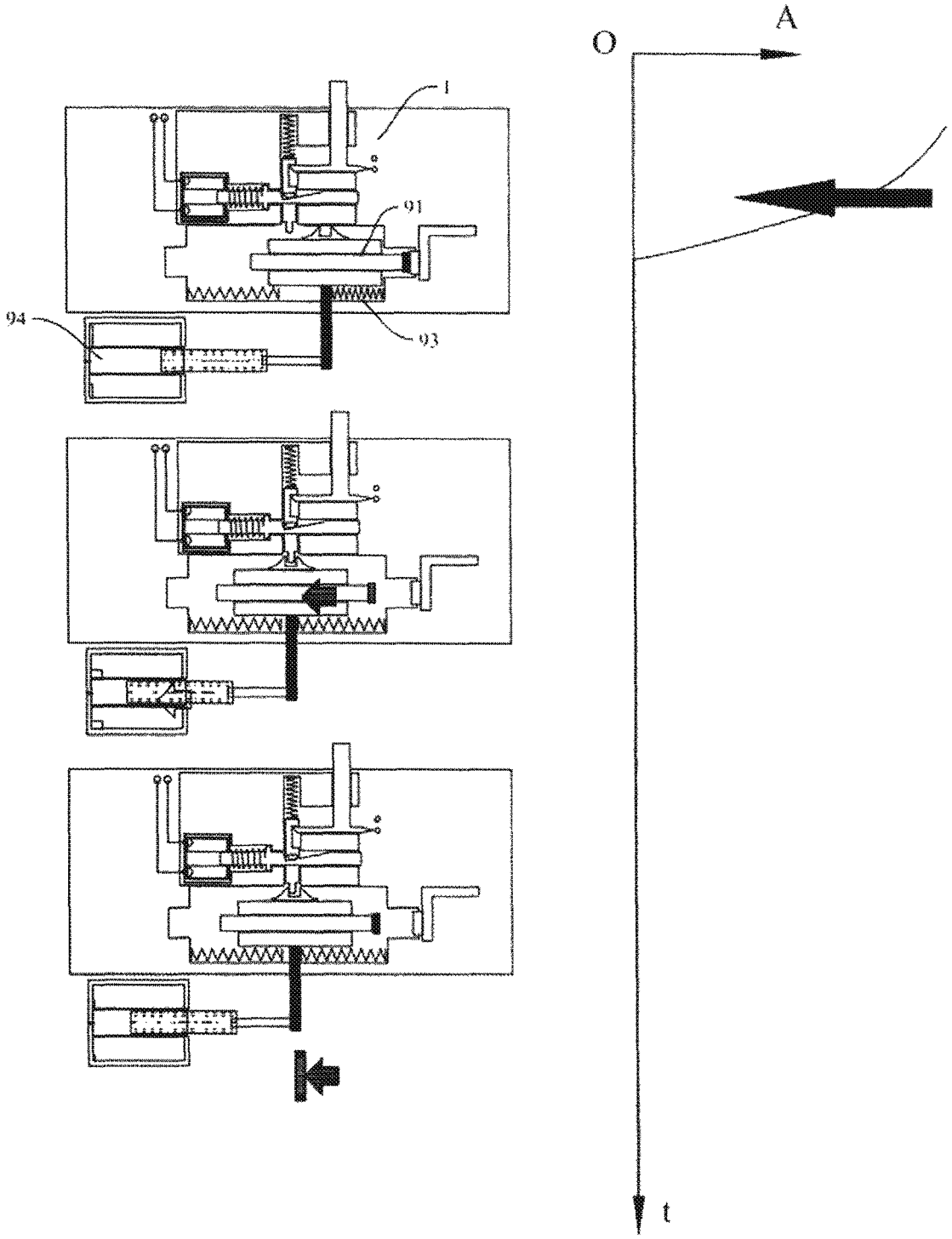
FIG. 7 is a diagram showing a process of the dual power switch returning to the intermediate open position under a combined action of the energy-storage spring, an electromagnet and the circuit breaking safety lock.
Figure 8:
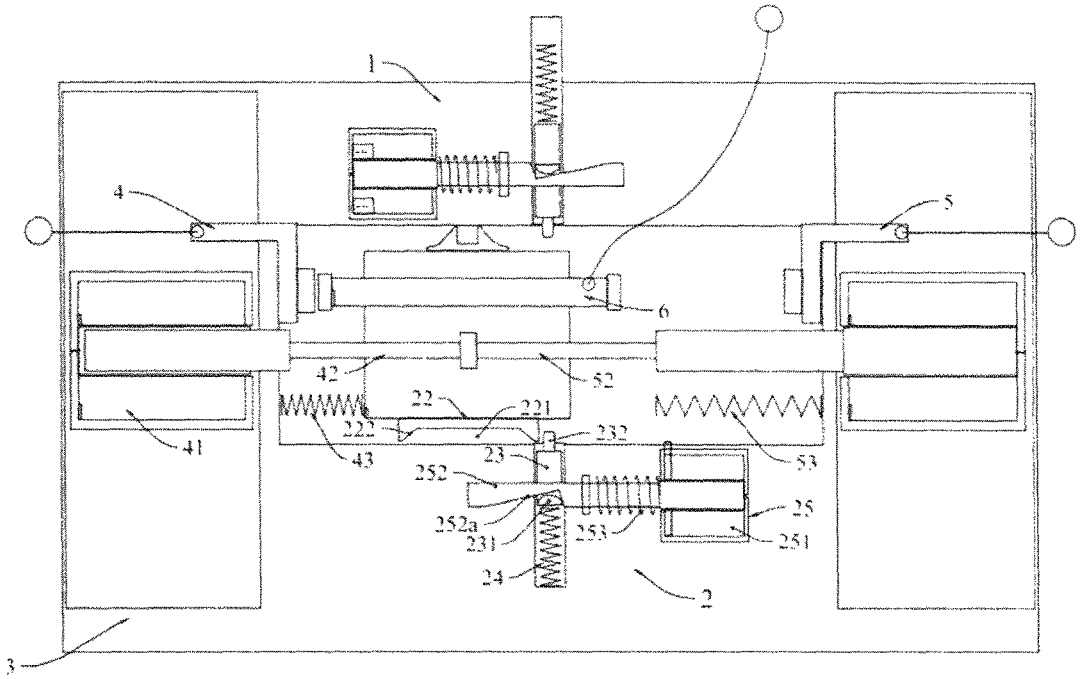
FIG. 8 is an overall structural diagram of a dual power switch of the invention.

FIG. 7 is a diagram showing the process of the dual power switch returning to the intermediate open position under the combined action the energy-storage spring, the electromagnet and the circuit breaking safety lock. As shown in FIG. 7, the dual power switch comprises the circuit breaking safety lock 1. The right energy-storage spring 93 together with the electromagnet 94 exerts a force on a movable electrode 91 to move it leftwards. It can be seen from the comparison of movement curve in FIG. 6 that both the connection point breaking and the returning to the intermediate open position of the movable electrode 91 are expedited apparently. When the movable electrode 91 moves to the intermediate open position, the circuit breaking safety lock 1 still can lock the movable electrode 91 immediately. The simultaneous actions of the energy-storage spring and the electromagnet (or other mechanical power) can provide a high-tension breaking capability by which the contacts that are already welded can be pulled apart, while the circuit breaking safety lock may ensure a quick return of the high-speed and high-tension movable electrode to the intermediate open position. In FIG. 8 a specific structure of the dual power switch of the invention is shown. As shown in FIG. 8, the dual power switch of the invention comprises a housing 3, a first position electrode 4, a second position electrode 5, a movable electrode 6, a bi-position lock 2 and the circuit breaking safety lock 1 described above, wherein the movable electrode 6 is fixedly connected with the slider 11 and moves between the first position electrode 4 and the second position electrode 5 with the slider 11.

The first position electrode 4 comprises a first position electromagnet 41, a first position shaft core 42 and a first position energy-storage spring 43 arranged at a side thereof, and the second position electrode 5 comprises a second position electromagnet 51, a second position shaft core 52 and a second position energy-storage spring 53 arranged at a side thereof. Both the first position shaft core 42 and the second position shaft core 52 are fixedly connected with the slider 11. Each of the first position energy-storage spring 43 and the second position energy-storage spring 53 is fixedly connected with the housing 3 at one end thereof, while the other end thereof is for providing power to the slider 11 to allow the slider 11 to reciprocally move. Specifically, the first position electromagnet 41 and the second position energy-storage spring 53 drive the slider 11 to move towards the first position electrode 4 simultaneously, while the second position electromagnet 51 and the first position energy-storage spring 43 drive the slider 11 to move towards the second position electrode 5 simultaneously. This method of providing power for the movement of the slider 11 through cooperation of the energy-storage spring and the electromagnet may expedite the circuit breaking of the movable electrode 6 and reduce the damage caused by electric arc to the contacts. Moreover, an electrical short circuit or runaway of welded contacts of the electrodes may also be avoided by adopting the powerful electromagnet to help move the slider 11. In different embodiments, it would be possible that only the energy-storage spring is used to provide restoring force.

As shown in FIG. 8, the bi-position lock, for locking the movable electrode 6 with the first position electrode 4 or the second position electrode 5, comprises a second locking piece 22, a second locking shaft 23, a second pressure spring 24 and a second lifting mechanism 25.

The second locking piece 22 and the slider 11 are fixedly connected, with a second notch 221 provided therebetween for guiding the second locking shaft 23 to slide, and the second notch 221 is provided at two inner lateral sides thereof with second sliding surfaces 222. Preferably, the second sliding surfaces 222 are circular arc surfaces or beveled surfaces.

The second locking shaft 23 is arranged peripherally of the slider 11 and is displaceable up and down linearly relative to the slider 11, for locking with the two sides of the second locking piece 22 in a snap-fit manner. The second locking shaft 23 is provided with a second locking shaft head 232 at an end thereof in contact with the second locking piece 22, and the second locking shaft head 232 is provided with a rounded contact corner.

The second pressure spring 44 abuts on an end of the second locking shaft 23 facing away from the second locking piece 22, for moving the second locking shaft 23 along a direction towards the slider 11. During both the up and down movements of the second locking shaft 23, the second pressure spring 44 is in a compressed state, thus to ensure a sliding contact between the second locking shaft 23 and the second locking piece 12. When the second locking shaft 23 passes over an uppermost point of the second sliding surfaces 222 of the second locking piece 22, the second locking shaft head 232 slides out of the first notch 121 under the effect of the second pressure spring 24 and is locked with the two sides of the second locking piece 22.

The second lifting mechanism 25 is arranged peripherally of the slider, for moving the second locking shaft 23 along a direction away from the slider 11. The second lifting mechanism 25 comprises a second electromagnet 251, a second shaft core 252 and a second shaft core spring 253 sleeved on the second shaft core 252, wherein the second shaft core 252 is provided with a second beveled lifting surface 252*a* at a portion thereof in contact with the second locking shaft 23, and the second locking shaft 23 is provided with a second force-bearing portion 231 matched with the second beveled lifting surface 252*a*.

Figure 9A:
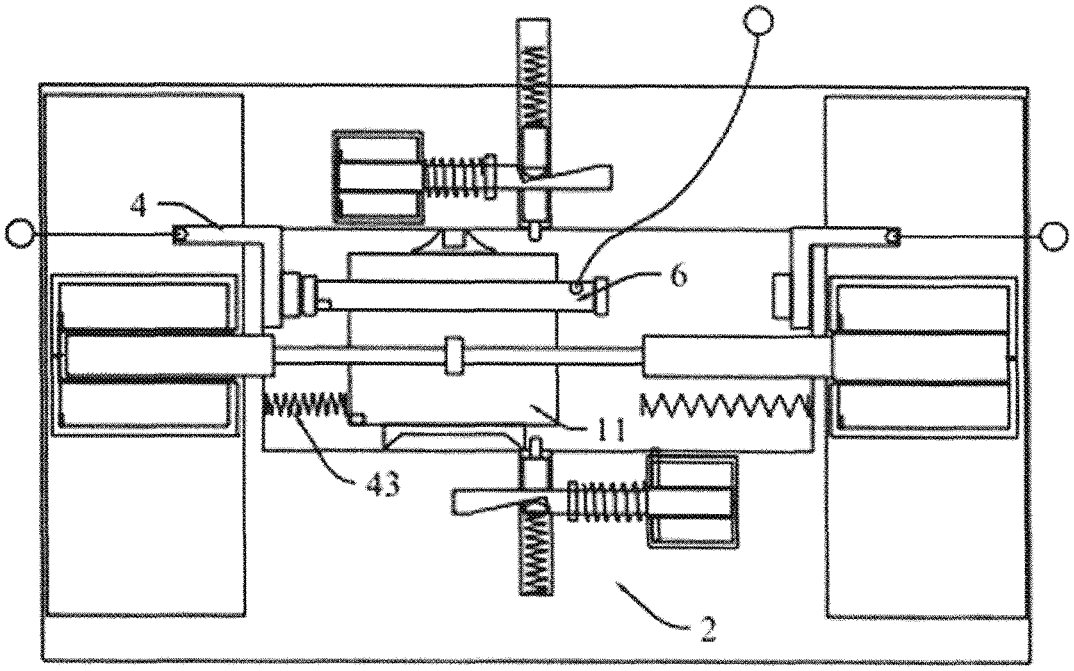
FIG. 9(*a*) is a schematic diagram of the dual power switch of the invention in a state where the first position electrode is connected.
Figure 9B:
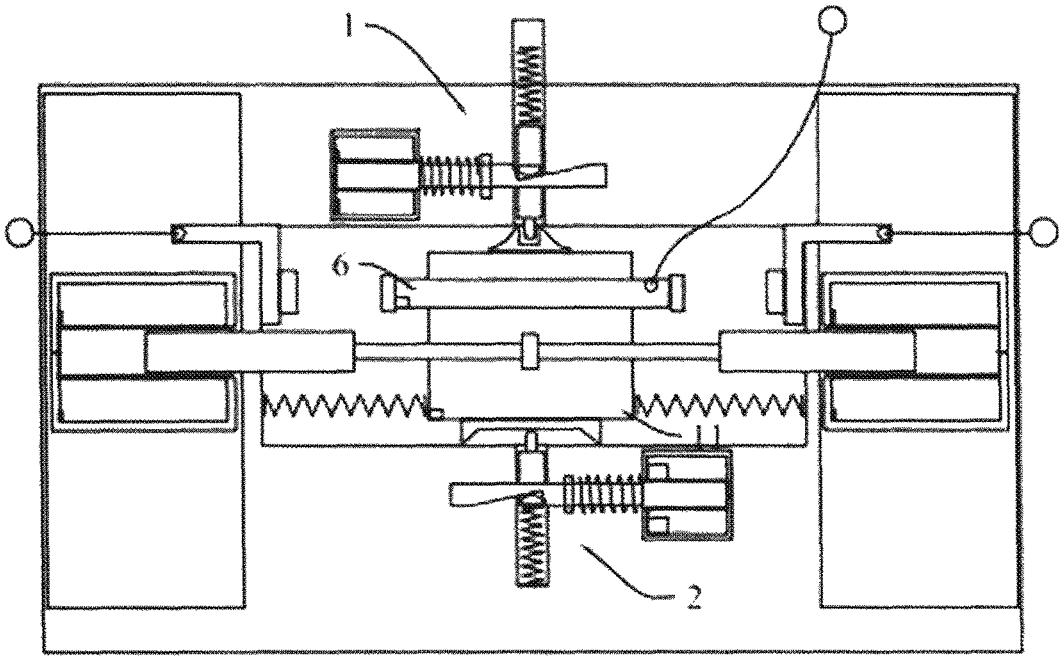
Figure 9C:
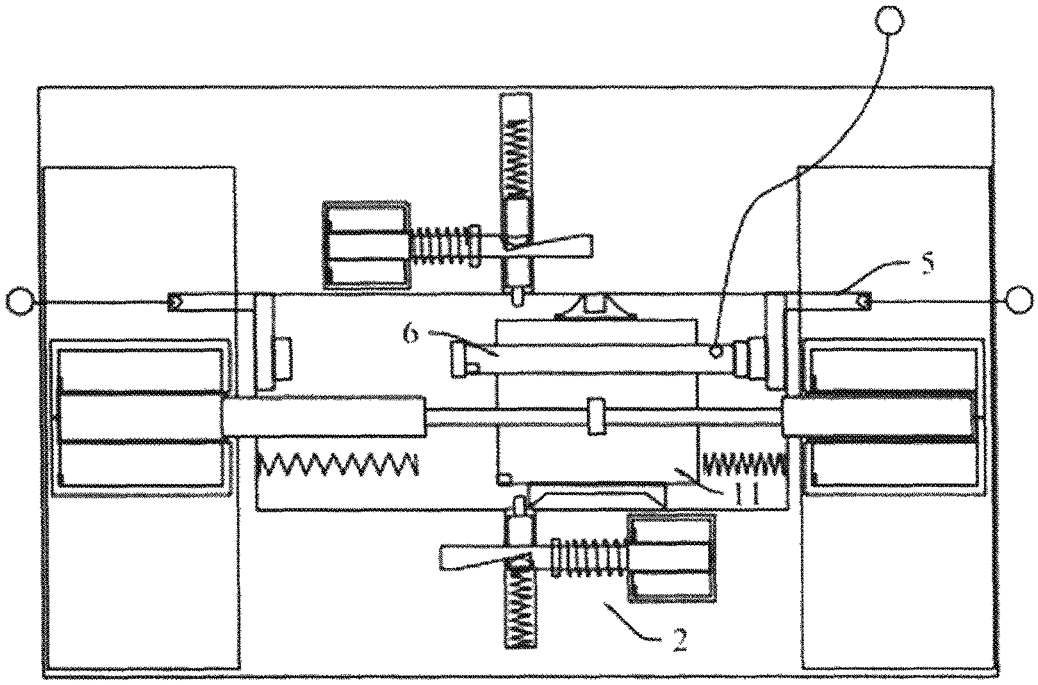

FIG. 9(*a*) to 9(*c*) are schematic diagrams showing three states of the dual power switch of the invention.

FIG. 9(*a*) is a schematic diagram showing the dual power switch of the invention in a state where a first position electrode is connected. In this state, the movable electrode 6 and the first position electrode 4 are connected, the slider 11 is locked by the bi-position lock 2, and the first position energy-storage spring is in a compressed energy-storing state.

FIG. 9(*b*) is a schematic diagram showing the dual power switch of the invention in an intermediate open state. In this state, the movable electrode 6 is in the intermediate open position, and the slider 11 is locked by the circuit breaking safety lock 1 other than the bi-position lock 2.

FIG. 9(*c*) is a schematic diagram showing the dual power switch of the invention in a state where the second position electrode is connected. In this state, the movable electrode 6 and the second position electrode 5 are connected, the slider 11 is locked by the bi-position lock 2, and the second position energy-storage spring is in a compressed energy-storing state.

While preferred embodiments of the present invention have been illustrated in detail above, the present invention is not limited thereto. The skilled in the art may make various equivalents or alternatives without departing from the spirit of the present invention. It is intended that all such equivalents or alternatives fall within the scope defined by the claims of the present invention.

The invention claimed is:

1. A circuit breaking safety lock, comprising:

a slider; a first locking piece, fixedly connected with the slider; a first locking shaft, arranged peripherally of the slider, and configured to be displaceable up and down linearly relative to the slider, and to be locked with the first locking piece in a snap-fit manner; a first pressure spring, abutting on a side of the first locking shaft facing away from the first locking piece, for moving the first locking shaft along a direction towards the slider; and a first lifting mechanism, arranged peripherally of the slider, for moving the first locking shaft along a direction away from the slider.

2. The circuit breaking safety lock according to claim 1, wherein the first lifting mechanism comprises a first electromagnet, a first shaft core and a first shaft core spring sleeved on the first shaft core, wherein the first shaft core has a first beveled lifting surface at a portion thereof in contact with the first locking shaft, and the first locking shaft has a first force-bearing portion matched with the first beveled lifting surface.

3. The circuit breaking safety lock according to claim 1, wherein the first locking piece is provided with a first notch in a middle portion thereof for receiving an end of the first locking shaft, and has two lateral sides served as first sliding surfaces for guiding.

4. The circuit breaking safety lock according to claim 3, wherein the first sliding surfaces are circular arc surfaces or beveled surfaces.

5. The circuit breaking safety lock according to claim 3, wherein the first locking shaft, at one end thereof in contact with the first locking piece, is provided with a first locking shaft head which is provided with a rounded contact corner.

6. The circuit breaking safety lock according to claim 1, further comprising a manual control lever, wherein the manual control lever is provided with a helically beveled surface at one end thereof in contact with the first locking shaft, and the first locking shaft is provided with a lateral groove matched with the helically beveled surface.

7. A dual-power switch, comprising a housing, a first position electrode, a second position electrode, a movable electrode, a bi-position lock and the circuit breaking safety lock according to claim 1, wherein the movable electrode is fixedly connected with the slider and moves between the first position electrode and the second position electrode with the slider.

8. The dual-power switch according to claim 7, further comprising a first position electromagnet and a first position shaft core at a side of the first position electrode, and a second position electromagnet and a second position shaft core at a side of the second position electrode, wherein the first position shaft core and the second position shaft core are both fixedly connected with the slider.

9. The dual-power switch according to claim 7, further comprising a first position energy-storage spring fixedly connected with the housing and arranged at the side of the first position electrode, and a second position energy-storage spring fixedly connected with the housing and arranged at the side of the second position electrode.

10. The dual-power switch according to claim 7, wherein the bi-position lock comprises:

a second locking piece, fixedly connected with the slider;

a second locking shaft, arranged peripherally of the slider, and configured to be displaceable up and down linearly relative to the slider, and to be locked with two sides of the second locking piece in a snap-fit manner;

a second pressure spring, abutting on a side of the second locking shaft facing away from the second locking piece, for moving the second locking shaft along a direction towards the slider; and a second lifting mechanism, arranged peripherally of the slider, for moving the second locking shaft along a direction away from the slider.

11. The dual-power switch according to claim 10, wherein the second lifting mechanism comprises a second electromagnet, a second shaft core and a second shaft core spring sleeved on the second shaft core, wherein the second shaft core has a second beveled lifting surface at a portion thereof in contact with the second locking shaft, and the second locking shaft has a second force-bearing portion matched with the second beveled lifting surface.

12. The dual-power switch according to claim 11, wherein the second locking piece in a middle portion thereof has a second notch for guiding the second locking shaft in sliding, and the second notch is provided with second sliding surfaces at two inner lateral sides thereof.

13. The dual-power switch according to claim 12, wherein the second sliding surfaces are circular arc surfaces or beveled surfaces.

14. The dual-power switch according to claim 13, wherein the second locking shaft is provided with a second locking shaft head at one end thereof in contact with the second locking piece, and the second locking shaft head is provided with a rounded contact corner.

* * * * *